United States Patent [19]

Pechnik et al.

[11] Patent Number: 4,943,320

[45] Date of Patent: Jul. 24, 1990

[54] VAPOR PHASE REDISTRIBUTION IN MULTI-COMPONENT SYSTEMS

[75] Inventors: Alexander Pechnik, Woodland Hills; M. Dean Matthews, Sararoga, both of Calif.

[73] Assignee: The Regents of the University of California, Berkeley, Calif.

[21] Appl. No.: 285,070

[22] Filed: Dec. 15, 1988

[51] Int. Cl.[5] ..... C22C 29/12

[52] U.S. Cl. ..... 75/235; 75/236; 75/241; 75/244; 264/125; 264/332; 419/10; 419/15; 419/17; 419/19; 419/48; 419/49; 419/68

[58] Field of Search ..... 75/235, 236, 241, 244; 419/10, 15, 17, 19; 264/125, 332

[56] References Cited

U.S. PATENT DOCUMENTS 4,092,263 5/1978 Zavitsanos ..... 252/181.4

4,273,582 6/1981 Gutjahr et al ..... 419/2

OTHER PUBLICATIONS

"The Chromium Diffusion Process," Product Finishing, v. 3, No. 10, pp. 32–37 (1950).

"Vapor Deposition," I. E. Campbell and C. F. Powell, Iron Age, 169, No. 15, pp. 113–117 (1952).

*Primary Examiner*—Stephen J. Lechert, Jr

*Assistant Examiner*—Leon Nigohosian, Jr.

*Attorney, Agent, or Firm*—Pretty, Schroeder, Brueggemann & Clark

[57] ABSTRACT

A process for preparing ceramic-metal composites without melting the metal is disclosed. A compact or green body is made from a ceramic and a metal, and the compact is sealed in a vacuum in a container such as a glass envelope. The compact is then heated to a temperature below the melting point of the metal, but high enough so that the vapor pressure of the metal is significant, and the metal redistributes through the ceramic by evaporation and condensation. The composite thereby forms a body having ceramic particles uniformly coated by the metal. Products formed by the process and fabrication of a $B_4C/Cr$ composite are also disclosed.

28 Claims, No Drawings

VAPOR PHASE REDISTRIBUTION IN MULTI-COMPONENT SYSTEMS

BACKGROUND OF THE INVENTION

1. Field of the Invention

This invention relates to multi-component systems, especially ceramic-metal composites and to methods of producing these systems, especially such composites. The invention provides a technique for redistributing one material, such as a metal, evenly throughout another material, such as a ceramic. This technique permits fabrication of materials, such as composites, that were formerly unattainable or attainable only at great cost.

2. Description of Related Art

Ceramic materials may be combined with metals to form composites having exceptional hardness, strength and fracture toughness. These materials are useful for cutting tools, structural materials, and armor.

Preferably, the composites are at least 50% ceramic material, and obtaining satisfactory metal distribution throughout a primarily ceramic body has proven very difficult. The metal distribution is important in adding toughness and in obtaining void-free densification.

In general, processes for impregnating a ceramic material with metal have followed two pathways. In the first pathway, a ceramic body is preformed and then coated with a metal. The metal is then driven into the ceramic body using various techniques. The second pathway involves forming a "green" body out of a mixture of ceramic and metal and then attempting to redistribute the two components within the body Various prior art techniques for either driving the metal into the ceramic or redistributing the metal in a ceramic-metal composite include: hot pressing, hot isostatic pressing and explosive compaction. Each of these techniques, however, is dependent upon the quality of metal distribution between the particles of the ceramic phase. Thus the techniques are limited by the type of ceramic-metal composites that can be formed.

Another technique for preparing a ceramic-metal composite involves heating the composite to a temperature higher than that of the melting point of the metal to encourage metal migration in the composite due to capillary action and surface tension. Often, this procedure is carried out in a vacuum or in the presence of an inert gas to ensure against chemical reaction or contamination of the liquid phase. These processes are exemplified by U.S. Pat. No. 4,605,440 to Halverson et al. (Halverson I) and U.S. Pat. No. 4,718,941 to Halverson et al. (Halverson II).

In Halverson I, a ceramic-metal "green body" is formed and then heated to a temperature from about 1050° C. to about 1250° C. for 2 to 10 minutes in an inert atmosphere or vacuum to obtain "wetting" of the ceramic by the metal. Halverson I is careful to point out that mass transfer between the ceramic and metal takes place during this process, and warns that prolonged heating affects the ultimate product due to inter-phase contamination.

In Halverson II, a ceramic "sponge" is impregnated with metal after preforming and chemical treatment to change the surface chemistry of the ceramic to permit wetting by the molten metal. As in Halverson I, impregnation takes place using capillary action and surface tension.

Unfortunately, the molten metal wetting technique of the Halverson patents is limited to those ceramic-metal systems that do not have either a high metal melting point or unacceptable wetting properties. What is needed in the art is a technique that can both provide for a broad range of ceramic-metal composites, avoid extensive phase intermingling during redistribution and provide a uniform distribution of metals within a ceramic-metal composite.

SUMMARY OF THE INVENTION

The invention provides a method for making a ceramic-metal composite with little phase intermingling and without the limitation that the metal wet the surface of the ceramic. In the method of the invention, a ceramic and a metal are mixed in proportion corresponding to the desired final product and formed into a green body. The green body is then encapsulated in a glass preform or in a glaze at elevated temperature and in vacuum. The temperature of the green body is then raised to a point at which the vapor pressure of the metal is significant. The metal evaporates and recondenses on the ceramic material. Ceramic particles in the composite thus become enveloped in a shell of metal, ensuring that the ceramic-metal composite will have outstanding properties and will not suffer from undue phase intermingling as a result of redistribution. The ceramic-metal composite is then ready for final treatment, for example by hot pressing or hot isostatic pressing.

The invention also comprises ceramic-metal composites made using the method of the invention.

Although the invention is preferably used to make ceramic-metal composites, the invention may be used to prepare a composite of any two materials. If a first material has a higher vapor pressure at a given temperature than a second material, then the first material will redistribute at that temperature to cover the second material. If, on the other hand, the two materials have a similar vapor pressure at a given temperature, then the two materials will tend to form an alloy upon redistribution, and the consistency of the alloy will be affected by the intimacy of the mixing between the two materials.

It is an object of the invention to provide materials such as ceramic-metal composites made by a new method that does not depend on wetting of the surface of one material, i.e., the ceramic by the other material, i.e., the metal and that does not cause undue phase intermingling.

One advantage of the invention is that materials can now be made that were formerly impossible or prohibitively expensive to make. Additional objects and advantages of the invention will be apparent from the description provided below.

DESCRIPTION OF THE PREFERRED EMBODIMENTS

The method of the invention comprises a technique for redistributing material in a two or more component mixture comprising the steps of: (a) mixing a first material and a second material; (b) placing the materials in a nonreactive environment; and (c) allowing the materials to redistribute at a temperature at which at least one of the materials has a significant vapor pressure.

In the preferred embodiment, the invention comprises a method for preparing a ceramic metal composite. The method comprises the steps of (a) preparing a ceramic-metal green body; (b) sealing the ceramic-metal green body in vacuum; (c) raising the temperature of the green body to a point where the vapor pressure of the metal becomes significant to achieve redistribution of the metal; and (d) treating the green body to form the final desired product.

Mixing the materials before redistribution is not strictly necessary to obtain some coating of one material by another. But, in the embodiment of two solid materials in powder form, the individual granules of material will be more likely to redistribute uniformly, if the particles are intimately mixed.

In the preferred embodiment, a formed mixture, called a green body, may be formed in any conventional manner. Preferably, however, ceramic and metal powders are mixed together in appropriate proportions using liquid dispersion or ball milling or attrition milling. A powder compact is then formed from the powder mixture using slip casting, and cold pressing, cold isostatic pressing or any other conventional greenware preparation technique to make the compact a green body.

Preferably, the mixture or green body should be substantially similar to the final desired product chemically and should have a ceramic grain size similar to the final product to ensure predictable and uniform characteristics of the final product.

After forming a mixture of the materials to undergo redistribution, the mixture is isolated from reactive factors in the environment to prevent contamination. For example, in the preferred embodiment, some metal, like titanium, are highly reactive with oxygen and oxygen containing materials at elevated temperatures. If titanium is one of the materials, the mixture should be kept away from air and water.

In the preferred embodiment, the green body is placed under vacuum or low pressure at an elevated temperature using a glass preform or a glazing operation. The glass or glazing isolates the green body and the vacuum from the atmosphere. In an alternative embodiment, an inert atmosphere, made up of materials that do not react with the materials being redistributed at the temperatures and pressure involved in the redistribution, may be used in place of vacuum or low pressure. Depending on the inert atmosphere used, however, the atmosphere may act to suppress the vapor pressure of the material being redistributed and thus may cause the redistribution to take place at a higher temperature.

In the preferred embodiment, the green body may be placed in a glass preform or envelope in a vacuum furnace. The particular type of glass in the envelope or the particular type of glazing is not critical to the invention, so long as the preform or "envelope" or glazing is sufficiently strong to withstand the pressure differential between the atmosphere outside and the vacuum inside. The degree of vacuum is also not critical to the invention. The lower the pressure inside the envelope or glazing, however, the better the expected results.

The material encapsulating the green body need not be glass, although glass is preferred. In an alternative embodiment, the material may be a shell of some other material, such as titanium. The encapsulating material should be sufficiently strong to withstand any pressure differential to which it is exposed, and the material should not significantly react with any of the materials being redistributed at the temperatures and pressures of the redistribution process.

If the encapsulating material is glass, it preferably should not contain high levels of material that can react with the redistributing materials. For example, some of the composites that can be made using the method of this technique include titanium as one of the materials. At the temperatures and pressures of a metal-ceramic redistribution, titanium reacts with both oxygen and alkali oxides. Accordingly, the glass envelope preferably should be as free of dissolved oxygen and water as possible, and the glass should also preferably be a low alkali glass or a glass that contains an alkali of relatively low vapor pressure, such as lithium oxide. In the alternative, the green body may be covered with a small amount of titanium dust that can react with impurities in the glass and so protect the green body from potential degradation by the impurities.

After sealing the envelope or the glazing so that the vacuum may be maintained, the pressure outside the envelope may be returned to one atmosphere or higher. One atmosphere is preferred, for simplicity, but a higher or lower pressure may be used depending on the particular application of the invention, the strength of the envelope or glaze and the environment in which the process takes place.

The ceramic-metal composite green body is then heated to a temperature at which the vapor pressure of the metal becomes significant. The exact temperature at which the vapor pressure becomes "significant" will depend upon the nature of the metal in the composite and the desired speed of the process. If the green body is only heated to a relatively low temperature, then the redistribution of the metal in the green body will take a longer time, and a higher temperature will provide a more rapid reaction. An upper limit to the temperature is the melting point of the metal. Molten metal redistributes within the ceramic using a different mechanism. It will be apparent to those skilled in the art that the degree of vacuum, the vapor pressure and the temperature are interrelated. One skilled in the art will be aware that the selection of these conditions will be affected by the ceramic and metal.

The metal phase of the composite will redistribute through the composite by evaporation and subsequent condensation on the ceramic, and the ceramic particles become enveloped in a shell of metal. As a result, even distribution of the metal on the ceramic matrix can be obtained. Since the temperature is typically lower than a liquid phase redistribution, the tendency to form unwanted phases within the composite during redistribution is reduced. Since the temperature is lower than the melting point of the metal, this invention makes it possible to make many desirable metal-ceramic composites that could not be made or could only be made at great expense, since the melting point of some metals is so high that the chosen ceramic could be damaged or destroyed at or below the melting temperature of the metal.

The last step in the process is formation of the final product from the green body. This step is accomplished by subjecting the redistributed composite to a finishing technique such as hot pressing or hot isostatic pressing. Optionally, the glass envelope or glaze may be removed before forming the final product, but this step in not necessary to prepare the finished product.

The invention is illustrated in the following example, but the example does not serve to limit the invention to the particular combination shown.

EXAMPLE 1

PREPARATION OF $B_4C$/Cr CERAMIC/METAL COMPOSITE

Preparation of a $B_4C$/Cr composite under conventional procedures is very difficult because the melting point of Cr is about 1900° C. and the melt will react with $B_4C$ at that temperature to form undesired phases.

A 60% $B_4C$ 40% Cr (by volume) powder compact was prepared by mixing starting powders in an alumina crucible. A pellet was pressed from the starting powder mixture in a WC/Co die under vacuum and then the pellet was placed inside of a glass preform. The preform and pellet were then put into a vacuum furnace. After outgassing at a temperature below 800° C., the sample was sealed in glass under vacuum at 825° C.

The vacuum furnace was then cooled down and the encapsulated pellet was removed and placed in a high temperature oven and heat treated at 1200° C. for 30 minutes. The pellet was then removed from the oven, cooled and allowed to sit for two weeks. Upon examination, the Cr was very uniformly distributed within the pellet.

EXAMPLE 2

PREPARATION OF $B_4C$/Ti CERAMIC/METAL COMPOSITE

Eight grams of a mixture of 60 weight percent $B_4C$ (1 micron) and 40 weight percent Ti (1–5 microns) was mixed with 4 ml water, and formed into a slip. The slip was ultrasonically dismembrated to break down agglomerates. The slip was then cast into a 2 piece gypsum mold, yielding a strong green body.

The green body was placed into a glass envelope and heated to 515° C. in a 10 mtorr vacuum, where it remained for two hours. The temperature was then raised to 900° C. and the envelope was left for 30 minutes. The vacuum valve of the vacuum furnace was then closed and Argon gas was introduced into the vacuum furnace up to 1 atmosphere. The temperature was then raised to 1545° C. and the glass envelope remained exposed to the elevated temperature for 30 minutes. The envelope was then permitted to cool in the oven after the heat was turned off.

The cooled sample was placed in a hot press and heated slowly to 1000° C. The sample was hot isostatically pressed in glass at 4000 psi for 30 minutes. The sample was then hot ejected at 700° C., and cut on slow speed diamond saw. The sample was then polished and measured for hardness using the Knoop hardness test. A hardness of 1000 was measured, and SEM analysis showed very little porosity in the sample (about 2 microns).

Aluminum oxide and copper have also been formed into a composite using this technique.

It will be understood by those of skill in the art that various modifications and alterations may be made to the invention without departing from the scope and spirit thereof.

We claim:

1. A process for making a product of at least two materials, comprising a first material and a second material, comprising the steps of:

(a) preparing a mixture of said materials;

(b) isolating said mixture from the environment; and (c) exposing said mixture to a temperature sufficient to enable at least said first material to redistribute within said mixture by means of vaporization and subsequent condensation.

2. The process of claim wherein said first material is a metal.

3. The process of claim 2, wherein said second material is a ceramic.

4. The process of claim 1, wherein said step of isolating said mixture is accomplished by reducing the pressure around said mixture and encapsulating said mixture.

5. A process for making a product comprising at least two materials comprising the steps of:

(a) preparing a mixture comprising a first material and a second material; and (b) heating said mixture to a temperature lower than the melting point of the lowest-melting of said materials but high enough to achieve redistribution of at least one of said materials through evaporation and subsequent condensation.

6. The process of claim 5, wherein at least one material is a metal.

7. The process of claim 5, wherein at least one material is a ceramic.

8. The process of claim 7, wherein at least one material is a metal.

9. The process of claim 8, wherein said product comprises a ceramic-metal composite.

10. The process of claim 6, wherein said metal is selected from the group consisting of metals having a vapor pressure of at least $10^{-4}$ torr at said temperature.

11. The process of claim 9, wherein said ceramic-metal composite is selected from the group consisting of: $Al_2O_3$/Cu, $B_4C$/Ti and $B_4C$/Cr.

12. A process for preparing a ceramic-metal product, comprising the steps of:

(a) forming a composite from a ceramic and metal;

(b) encapsulating said composite in a container at a low pressure;

(c) redistributing the metal in said composite by establishing a temperature within the container that is less than the melting point of the metal in said composite, but high enough to make the vapor pressure of said metal significant; and (d) consolidating the composite to make said product.

13. The process of claim 12, wherein said ceramic-metal composite is a composite of $B_4C$ and Ti or Cr.

14. The process of claim 13, wherein said ceramic-metal composite is in a ratio of 60% $B_4C$ to 40% Ti or Cr by volume in the initial composite.

15. The process of claim 12, wherein said step of forming a composite comprises forming a compact from a mixture of a powder comprising a metal and a powder comprising a ceramic.

16. The process of claim 15, wherein said compact is formed from said powder by a process chosen from slip casting, cold pressing or cold isostatic pressing.

17. The process of claim 12, wherein said step of encapsulating said composite in a container comprises placing said composite in a glass envelope.

18. The process of claim 12, wherein said step of encapsulating said composite in a container comprises placing said composite in a glazing.

19. The process of claim 12, wherein said step of encapsulating said composite in a container takes place in a vacuum furnace.

20. The process of claim 12, wherein said low pressure essentially comprises a vacuum.

21. The process of claim 12, wherein said step of consolidating comprises hot pressing or hot isostatic pressing.

22. A process for preparing a ceramic-metal product comprising the steps of:

(a) mixing a powder comprising a metal and a powder comprising a ceramic to form a mixture;

(b) forming a compact from said mixture;

(c) encapsulating said compact in a body comprising a glass envelope or a glaze and maintaining the interior of said body containing said compact substantially at vacuum pressure;

(d) heating said compact to a temperature below the melting point of said metal, but sufficient to permit evaporation and condensation of said metal within said compact;

(e) allowing said metal within said compact to redistribute within said compact to form a substantially uniform microstructure; and (f) consolidating said compact to form said product.

23. The process of claim 22, further comprising the step of elevating the temperature of said compact during said step of encapsulating said compact.

24. The process of claim 22, further comprising the step of removing said compact from said body after said step of heating said compact to a temperature below the melting point of said metal.

25. A product made by the process of claim 1.

26. A product made by the process of claim 5.

27. A product made by the process of claim 12.

28. A product made by the process of claim 22.

* * * * *

UNITED STATES PATENT AND TRADEMARK OFFICE

CERTIFICATE OF CORRECTION

PATENT NO. : 4,943,320

DATED : July 24, 1990

INVENTOR(S) : Alexander Pechenik et al

It is certified that error appears in the above-identified patent and that said Letters Patent is hereby corrected as shown below:

On the title page:

Item [19] "Pechnik et al" should be --Pechenik et al--.

Item [75] Inventors: "Alexander Pechnik" should be --Alexander Pechenik--.

Signed and Sealed this

Seventeenth Day of March, 1992

*Attest:*

HARRY F. MANBECK, JR.

*Attesting Officer*

*Commissioner of Patents and Trademarks*